US008079337B2

(12) United States Patent
Kim et al.

(10) Patent No.: US 8,079,337 B2
(45) Date of Patent: Dec. 20, 2011

(54) VARIABLE VALVE LIFT APPARATUS

(75) Inventors: Back Sik Kim, Osan (KR); Ingee Suh, Yongin (KR); Dong Hee Han, Seoul (KR); Hyung Ick Kim, Gunpo (KR); Myungsik Choi, Seoul (KR); Dae Sung Kim, Hwaseong (KR); Kyoung Pyo Ha, Suwon (KR)

(73) Assignee: Hyundai Motor Company, Seoul (KR)

( * ) Notice: Subject to any disclaimer, the term of this patent is extended or adjusted under 35 U.S.C. 154(b) by 343 days.

(21) Appl. No.: 12/548,118

(22) Filed: Aug. 26, 2009

(65) Prior Publication Data

US 2010/0139589 A1 Jun. 10, 2010

(30) Foreign Application Priority Data

Dec. 5, 2008 (KR) ..... 10-2008-0123564

(51) Int. Cl.
*F01L 1/18* (2006.01)

(52) U.S. Cl. ..... 123/90.39; 123/90.12; 123/90.44; 74/559; 74/569

(58) Field of Classification Search ..... 123/90.39, 123/90.44, 90.12, 90.13; 74/559, 567, 569
See application file for complete search history.

(56) References Cited

U.S. PATENT DOCUMENTS 6,769,387 B2 * 8/2004 Hayman et al. ..... 123/90.39

FOREIGN PATENT DOCUMENTS

KR 10-2008-0026841 A 3/2008

* cited by examiner

*Primary Examiner* — Ching Chang
(74) *Attorney, Agent, or Firm* — Morgan, Lewis & Bockius LLP

(57) ABSTRACT

A variable valve lift apparatus may include an inner body of which an end is pivotally connected to an anchor, an outer body of which an end is pivotally connected to the anchor, a roller finger follower of which an end is pivotally connected to a hydraulic lash adjuster, wherein a portion of the roller finger follower is pivotally connected to the outer body, a valve disposed to the other end of the roller finger follower, and a connecting unit selectively connecting the inner body and the outer body.

15 Claims, 4 Drawing Sheets

VARIABLE VALVE LIFT APPARATUS

CROSS-REFERENCE TO RELATED APPLICATION

The present application claims priority to Korean Patent Application No. 10-2008-0123564 filed on Dec. 5, 2008, the entire contents of which application is incorporated herein for all purposes by this reference.

BACKGROUND OF THE INVENTION

1. Field of the Invention

The present invention relates to a variable valve lift. More particularly, the present invention relates to a variable valve lift that can adjust a valve lift amount in response to an operational state of an engine.

2. Description of Related Art

An internal combustion engine generates power by burning fuel in a combustion chamber in an air media that is drawn into the chamber. Intake valves are operated by a camshaft in order to take in the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, optimal opening/closing timing of the valves or an optimal lift depends on the rotation speed of the engine. In order to achieve such an optimal valve operation depending on the rotation speed of the engine, research has been undertaken on a variable valve lift (VVL) apparatus that enables different valve lifts depending on the engine speed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve lift (VVL) apparatus having advantages of minimized friction and power loss with simple structure and enhanced controllability and assemblability.

In an aspect of the present invention, the variable valve lift apparatus may include an inner body of which an end is pivotally connected to an anchor, an outer body of which an end is pivotally connected to the anchor, a roller finger follower of which an end is pivotally connected to a hydraulic lash adjuster, wherein a portion of the roller finger follower is pivotally connected to the outer body, a valve disposed to the other end of the roller finger follower, and a connecting unit selectively connecting the inner body and the outer body.

The connecting unit may include a latching plunger chamber formed in the inner body, a latching plunger that is slidably disposed in the latching plunger chamber and selectively connected to the outer body, a latching plunger elastic member that is disposed in the latching plunger chamber and supplies elastic force to the latching plunger, and a hydraulic pressure supplying portion that selectively supplies hydraulic pressure to the latching plunger.

The hydraulic pressure supplying portion may supply the hydraulic pressure to the latching plunger chamber via a hydraulic line formed in the anchor.

The variable valve lift apparatus may further include a lost motion spring disposed to the inner body for elastically supporting the inner body.

The roller finger follower may be substantially parallel to the inner body and the outer body as a pair and the inner body and the outer body are disposed between the roller finger followers.

A supporting plate may be protrudedly formed from the outer body and a bearing shaft connecting hole is formed to the supporting plate for connecting the roller finger follower therethrough, wherein a bearing insert hole is formed in the roller finger follower and a bearing shaft fastened to the outer body is inserted into the bearing insert hole and the bearing shaft connecting hole, wherein a roller is rotatably disposed to the bearing shaft, and wherein a diameter of the bearing insert hole is larger than a diameter of the bearing shaft.

The anchor may be connected to at least one of a cylinder head and a cam carrier, wherein an oil gallery is formed in the at least one of the cylinder head and the cam carrier.

A pad portion may be formed to an upper portion of the inner body.

In another aspect of the present invention, the variable valve lift apparatus may include an inner body of which an end is pivotally connected to an anchor and a pad portion is formed thereto, a lost motion spring disposed to the inner body for supplying elastic force to the inner body, an outer body of which an end is pivotally connected to the anchor, a roller finger follower pivotally connected to the outer body, a valve coupled to the other end of the roller finger follower, and a connecting unit selectively connecting the inner body and the outer body.

The connecting unit may include a latching plunger chamber formed in the inner body, a latching plunger that is slidably disposed in the latching plunger chamber and selectively connected to the outer body, a latching plunger elastic member that is disposed in the latching plunger chamber and supplies elastic force to the latching plunger, and a hydraulic pressure supplying portion that selectively supplies hydraulic pressure to the latching plunger, wherein the hydraulic pressure supplying portion supplies the hydraulic pressure to the latching plunger chamber via an oil gallery, which is formed at least one of a cam carrier and a cylinder head, and a hydraulic line formed in the anchor.

As described above, the variable valve lift apparatus according to an aspect of the present invention may operate two valves simultaneously with simple scheme and adjust clearance easily.

The variable valve lift apparatus may be stably configured to a cam carrier or a cylinder head through an anchor and be realized without changing other structures of a valve train.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
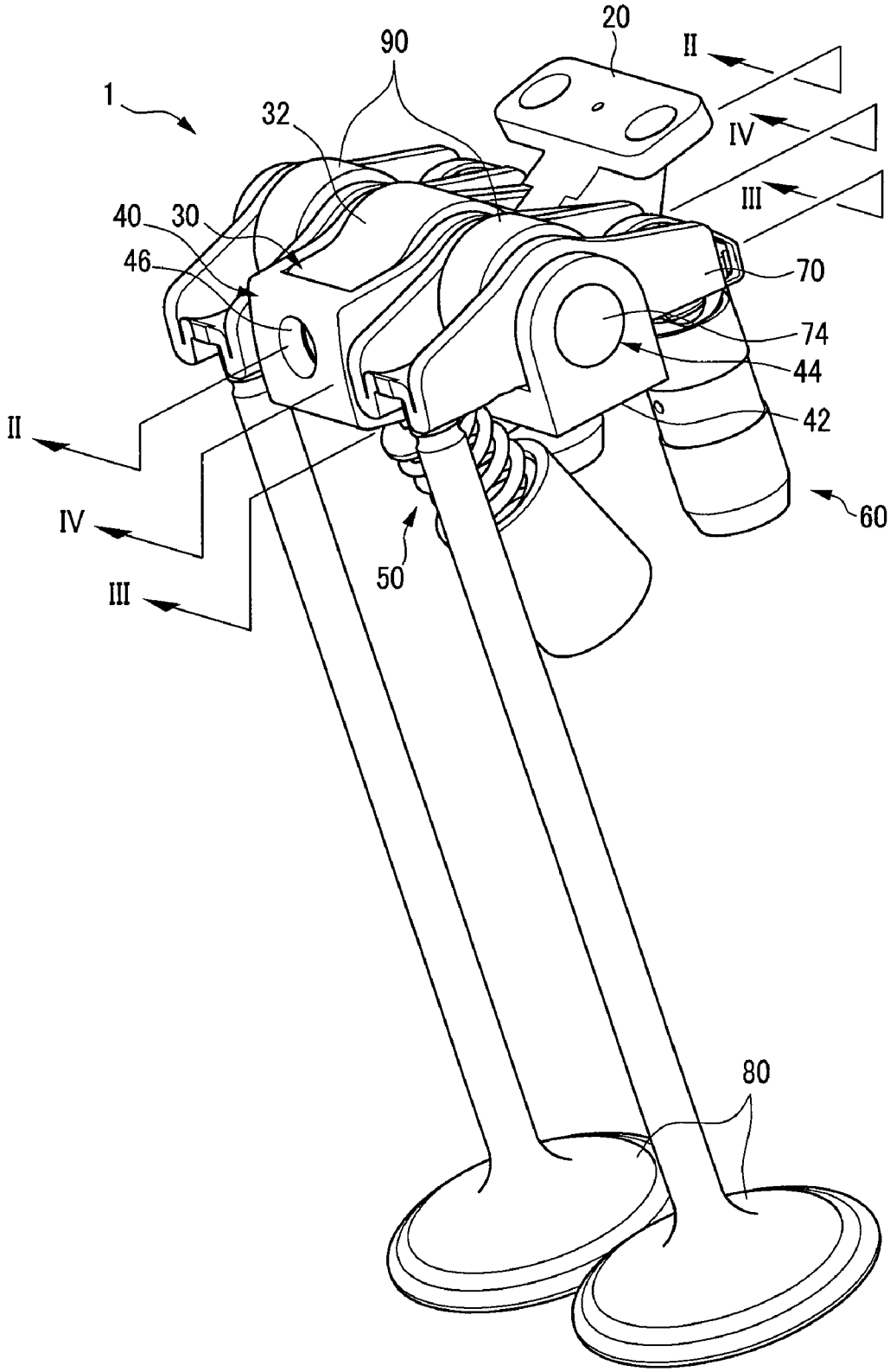
FIG. 1 is a perspective view of a variable valve lift apparatus according to an exemplary embodiment of the present invention.
Figure 2:
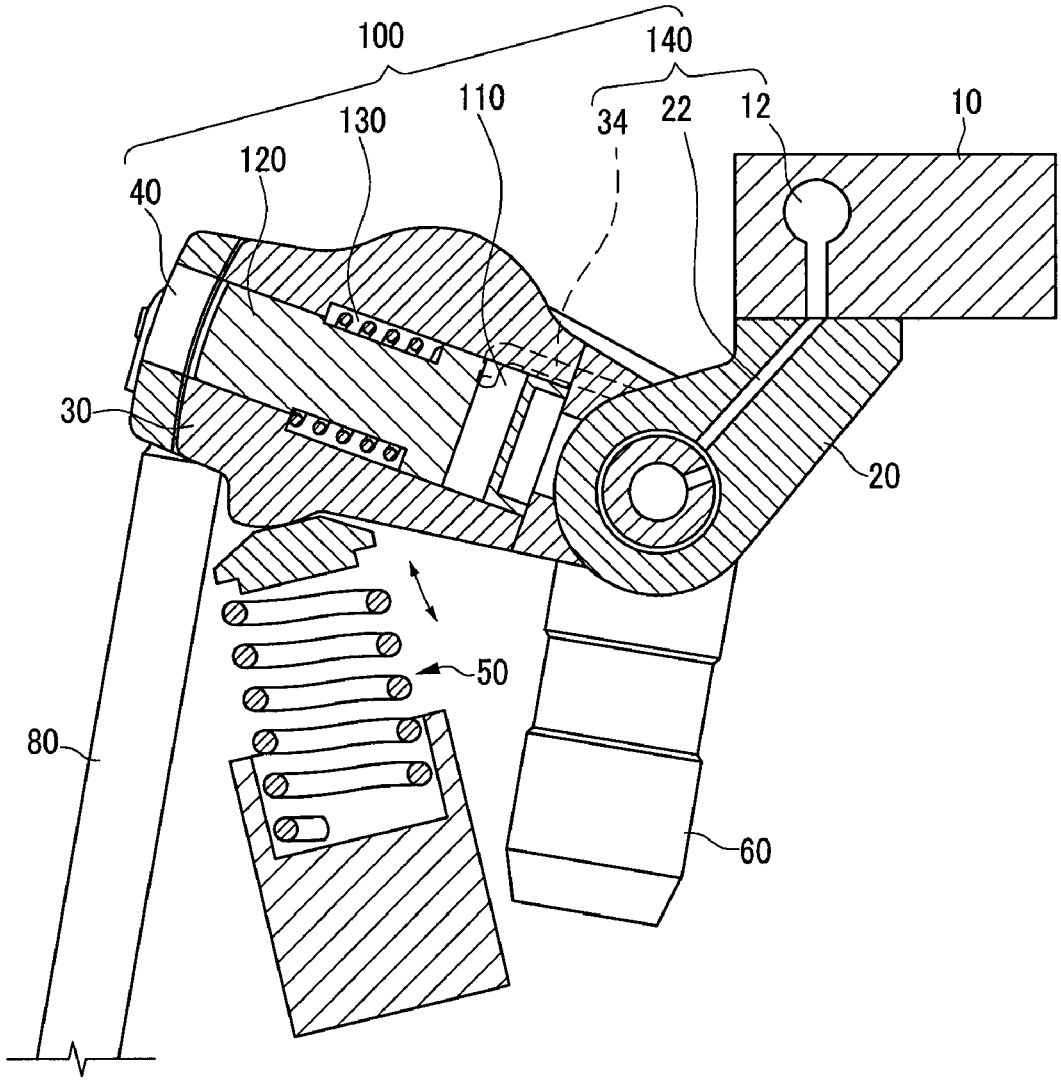
FIG. 2 is a cross-sectional view along line II-II of FIG. 1.

FIG. 1 is a perspective view of an exemplary variable valve lift apparatus according to various embodiments of the present invention and FIG. 2 is a cross-sectional view along line II-II of FIG. 1.

Figure 3:
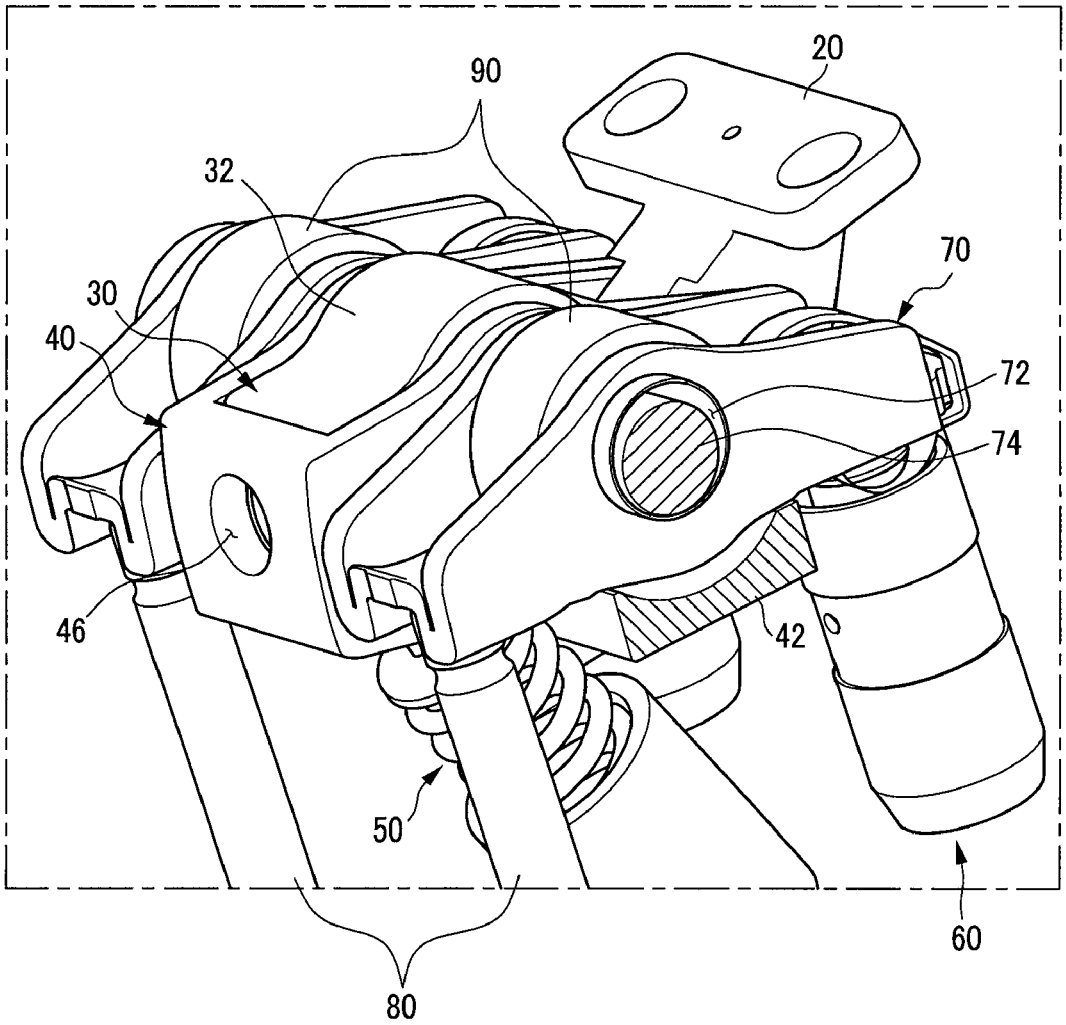
FIG. 3 is a cross-sectional view along line III-III of FIG. 1.
Figure 4:
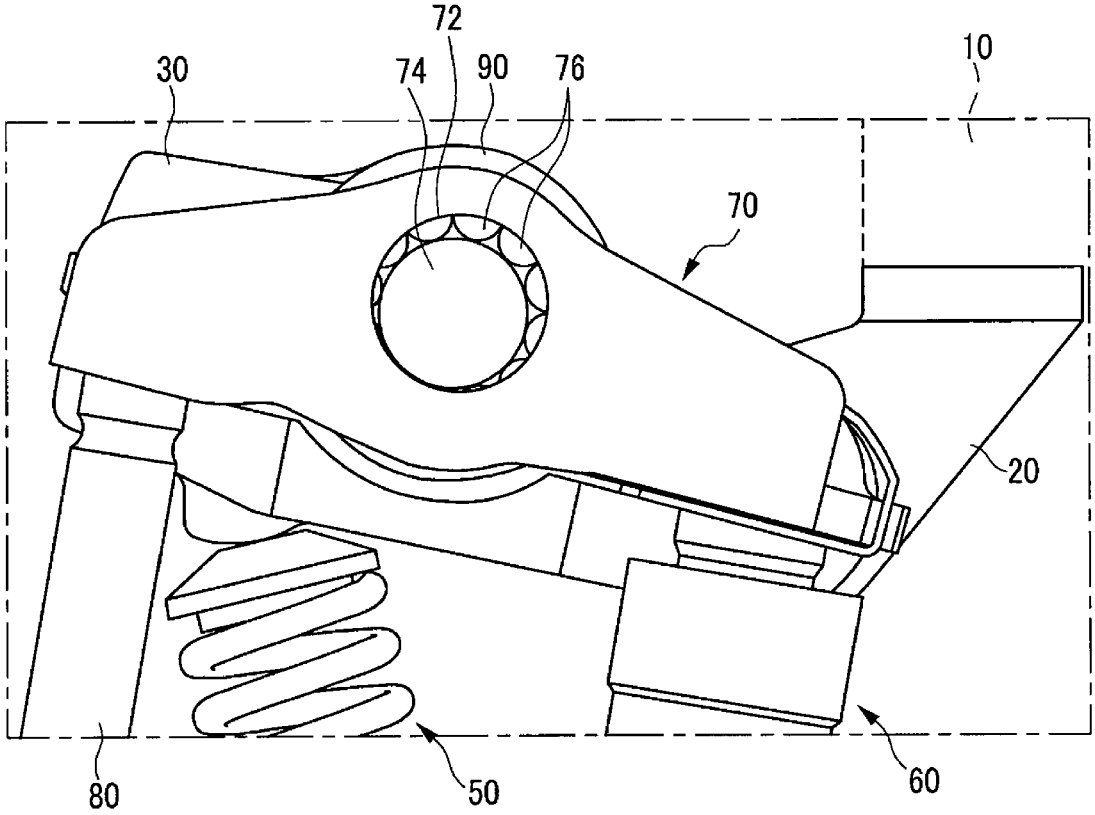
FIG. 4 is a cross-sectional view along line IV-IV of FIG. 1.

FIG. 3 is a cross-sectional view along line III-III of FIG. 1 and FIG. 4 is a cross-sectional view along line IV-IV of FIG. 1.

Referring to FIG. 1 and FIG. 2, a variable valve lift apparatus 1 according to various embodiments of the present invention includes an anchor 20 that is disposed to at least one of a cam carrier or cylinder head 10, an inner body 30 that is pivotally disposed to the anchor 20 and the outer body 40 that is pivotally disposed to the anchor 20.

A lost motion spring 50 is disposed for supplying restoring force to the inner body 30 and a hydraulic lash adjuster (HLA) 60 is disposed near the anchor 20.

A roller finger follower 70, of which one end is connected to the hydraulic lash adjuster 60, pivots around the hydraulic lash adjuster 60 and is connected to the outer body 40.

A valve 80 is disposed to the other end of the roller finger follower 70, and the inner body 30 and the outer body 40 are selectively connected by a connecting unit 100.

The connecting unit 100 includes a latching plunger chamber 110 formed in the inner body 30, a latching plunger 120 that is disposed in the latching plunger chamber 110 and selectively connected to the outer body 40, a latching plunger elastic member 130 that is disposed in the latching plunger chamber 110 and supplies elastic force to the latching plunger 120 and a hydraulic pressure supplying portion 140 that selectively supplies hydraulic pressure to the latching plunger 120.

The hydraulic pressure supplying portion 140 supplies the hydraulic pressure to the latching plunger chamber 110 via the cam carrier or cylinder head 10 and the anchor 20.

That is, the hydraulic pressure controlled by an OCV (oil control valve) is supplied to the latching plunger chamber 110 through an oil gallery 12 formed to the cam carrier or cylinder head 10, a first hydraulic line 22 formed to the anchor 20 and a second hydraulic line 34 formed to the inner body 30 and selectively connected to the first hydraulic line 22. Thus, the hydraulic pressure may be stably supplied through the hydraulic pressure supply line.

Referring to FIG. 1, FIG. 3 and FIG. 4, the roller finger follower 70 is parallel to the inner body 30 and the outer body 40 as a pair and the inner body 30 and the outer body 40 are disposed between the roller finger followers 70.

A supporting plate 42 is protrudedly formed from the outer body 40 and a bearing shaft connecting hole 44 is formed to the supporting plate 42 for connecting the roller finger follower 70 therein.

A bearing insert hole 72 is formed to the roller finger follower 70 and a bearing shaft 74 is inserted into the bearing insert hole 72 and the bearing shaft connecting hole 44.

A diameter of the bearing insert hole 72 is substantially larger than a diameter of the bearing shaft 74. Thus, clearance of the valve can be adjusted allowing that rotation centers of the roller finger follower 70 and the inner body 30 or the outer body 40 are not matched.

That is, as shown in FIG. 4, if the diameter of the bearing insert hole 72 is substantially larger than the diameter of the bearing shaft 74 that is supported by a bearing 76, clearance of the valve can be easily adjusted.

A pad portion 32 is formed to the inner body 30 to contact to a high lift cam and a roller 90 is disposed to the bearing shaft 74 to contact a low lift cam.

Hereinafter, operations of the variable valve lift apparatus 1 according to various embodiments of the present invention will be explained.

In low lift mode, the hydraulic pressure is not supplied to the latching plunger chamber 110.

Then the latching plunger 120 is disposed within the inner body 30 by elastic force of the latching plunger elastic member 130, and the inner body 30 and the outer body 40 independently pivot around the anchor 20.

The roller finger follower 70 connected to the outer body 40 pivots by the low lift cam independently and drives the valve 80 regardless of pivoting of the inner body 30 contacting the high lift cam.

That is, the inner body 30, as shown in FIG. 2, pivots along an arrow direction and lost motion occurs.

In high lift mode, the hydraulic pressure is supplied to the latching plunger chamber 110.

Then the latching plunger 120 is inserted into the latching plunger connecting hole 46 formed to the outer body 40 so that the inner body 30 and the outer body 40 pivot integrally.

That is, the roller finger follower 70 connected to the outer body 40 pivots according to pivoting of the inner body 30 contacting the high lift cam.

And then, if the hydraulic pressure is released in the latching plunger chamber 110, the variable valve lift apparatus 1 is operated in the low lift mode.

The supplying of the hydraulic pressure and selection of the mode are obvious to the skilled person in the art, so detailed explanations thereof will be omitted.

For convenience in explanation and accurate definition in the appended claims, the terms "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

an inner body of which an end is pivotally connected to an anchor;

an outer body of which an end is pivotally connected to the anchor;

a roller finger follower of which an end is pivotally connected to a hydraulic lash adjuster, wherein a portion of the roller finger follower is pivotally connected to the outer body;

a valve disposed to the other end of the roller finger follower; and a connecting unit selectively connecting the inner body and the outer body.

2. The variable valve lift apparatus of claim 1, wherein the connecting unit comprises:

a latching plunger chamber formed in the inner body;

a latching plunger that is slidably disposed in the latching plunger chamber and selectively connected to the outer body;

a latching plunger elastic member that is disposed in the latching plunger chamber and supplies elastic force to the latching plunger; and a hydraulic pressure supplying portion that selectively supplies hydraulic pressure to the latching plunger.

3. The variable valve lift apparatus of claim 2, wherein the hydraulic pressure supplying portion supplies the hydraulic pressure to the latching plunger chamber via a hydraulic line formed in the anchor.

4. The variable valve lift apparatus of claim 2, wherein the variable valve lift apparatus further comprises a lost motion spring disposed to the inner body for elastically supporting the inner body.

5. The variable valve lift apparatus of claim 1, wherein the roller finger follower is substantially parallel to the inner body and the outer body as a pair and the inner body and the outer body are disposed between the roller finger followers.

6. The variable valve lift apparatus of claim 1, wherein a supporting plate is protrudedly formed from the outer body and a bearing shaft connecting hole is formed to the supporting plate for connecting the roller finger follower therethrough.

7. The variable valve lift apparatus of claim 6, wherein a bearing insert hole is formed in the roller finger follower and a bearing shaft fastened to the outer body is inserted into the bearing insert hole and the bearing shaft connecting hole.

8. The variable valve lift apparatus of claim 7, wherein a roller is rotatably disposed to the bearing shaft.

9. The variable valve lift apparatus of claim 7, wherein a diameter of the bearing insert hole is larger than a diameter of the bearing shaft.

10. The variable valve lift apparatus of claim 1, wherein the anchor is connected to at least one of a cylinder head and a cam carrier.

11. The variable valve lift apparatus of claim 10, wherein an oil gallery is formed in the at least one of the cylinder head and the cam carrier.

12. The variable valve lift apparatus of claim 1, wherein a pad portion is formed to an upper portion of the inner body.

13. A variable valve lift apparatus comprising:

an inner body of which an end is pivotally connected to an anchor and a pad portion is formed thereto;

a lost motion spring disposed to the inner body for supplying elastic force to the inner body;

an outer body of which an end is pivotally connected to the anchor;

a roller finger follower pivotally connected to the outer body;

a valve coupled to the other end of the roller finger follower; and a connecting unit selectively connecting the inner body and the outer body.

14. The variable valve lift apparatus of claim 13, wherein the connecting unit comprises:

a latching plunger chamber formed in the inner body;

a latching plunger that is slidably disposed in the latching plunger chamber and selectively connected to the outer body;

a latching plunger elastic member that is disposed in the latching plunger chamber and supplies elastic force to the latching plunger; and a hydraulic pressure supplying portion that selectively supplies hydraulic pressure to the latching plunger.

15. The variable valve lift apparatus of claim 14, wherein the hydraulic pressure supplying portion supplies the hydraulic pressure to the latching plunger chamber via an oil gallery, which is formed at least one of a cam carrier and a cylinder head, and a hydraulic line formed in the anchor.

* * * * *